US005366392A

United States Patent [19]

Raloff et al.

[11] Patent Number: 5,366,392

[45] Date of Patent: Nov. 22, 1994

[54] QUICK CONNECT ELECTRICAL CABLE CONNECTOR

[75] Inventors: Valgene E. Raloff, Grant Park; Christopher Haczynski, Beecher, both of Ill.

[73] Assignee: Bernard Welding Company, Beecher, Ill.

[21] Appl. No.: 6,480

[22] Filed: Jan. 21, 1993

[51] Int. Cl.[5] ..... H01R 9/24

[52] U.S. Cl. ..... 439/889; 439/346

[58] Field of Search ..... 439/337, 346, 737, 738, 439/739, 810, 814, 813, 889

[56] References Cited

U.S. PATENT DOCUMENTS

| | | | |
|---|---|---|---|
| 1,701,646 | 2/1929 | Taylor | 439/889 X |
| 2,952,830 | 9/1960 | Sperzel et al. | 439/889 X |
| 3,143,384 | 8/1964 | Senior, Jr. | 439/889 X |
| 3,469,070 | 9/1969 | Bernard et al. . | |
| 3,514,570 | 5/1970 | Bernard et al. . | |
| 4,702,539 | 10/1987 | Cusick, III et al. . | |
| 4,960,395 | 10/1990 | Ushler | 439/889 X |

FOREIGN PATENT DOCUMENTS

| | | |
|---|---|---|
| 1513907 | 6/1978 | United Kingdom . |
| 2098115 | 11/1982 | United Kingdom . |

OTHER PUBLICATIONS

Tweco Products, Inc.: "Positive-Cam Cable Connector Complete" (Undated).

Tweco: "Tweco Cable Connectors" (Undated).

Lenco: "Lenco Cable Connectors" (Undated).

Bernard: "Bernard® Manual Welding Accessories" (Undated).

*Primary Examiner*—Khiem Nguyen

*Attorney, Agent, or Firm*—Willian Brinks Hofer Gilson & Lione

[57] ABSTRACT

An electrical cable connector for releasably electrically connecting ends of an electrical cable comprises a female element coupled to one end of the electrical cable, and a male element coupled to another end of the electrical cable. The male element is releasably connectable with the female element. A locking groove is disposed on one of the female element and the male element. A screw is removably disposed on another one of the female element and the male element. A cam surface is located on the screw and is engagable with the locking groove such that the cam surface cams along the locking groove responsive to rotation of the female element relative to the male element to releasably connect the female element with the male element thereby electrically connecting the ends of the electrical cable. A slot is operatively associated with the locking groove. The slot is contractible responsive to camming of the cam surface along the locking groove to facilitate releasable connection of the female element with the male element. The slot is offset about 45 degrees counterclockwise from a latitudinal midline of the one of the female element and the male element.

11 Claims, 2 Drawing Sheets

QUICK CONNECT ELECTRICAL CABLE CONNECTOR

BACKGROUND OF THE INVENTION

The present invention generally relates to a novel quick connect electrical cable connector. More specifically, the invention relates to a novel in-line electrical cable connector for electrically connecting ends of an electrical cable.

Many different types of electrical cable connectors are available in the modem market. One type of electrical cable connector is an in-line connector which comprises releasably interconnectable, electrically conductive male and female portions. The male and female portions are connected to ends of electrical cables. By inserting the male portion into the female portion, the ends of the cables are electrically joined, thereby forming a single electrical conductor. Preferably, the male portion is removable from the female portion to allow for lengthening, replacement, servicing, etc. of the connector and/or the cable. Accordingly, in a preferred construction, the male and female portions are capable of repeated connections and disconnections.

One example of such a cable connector is disclosed in the U.S. Pat. No. 4,702,539 to Cusick, III et al. The connector comprises a male portion and a female portion coupled to ends of electrical cables. The male element has a projection releasably insertable into a bore in the female portion in order to electrically connect the ends of the cables. To provide a secure fit between the male and female portions, a mechanism is provided which draws the male portion into the female portion upon rotation of the male portion with respect to the female portion.

Specifically, the male portion has a spiral-like groove disposed along the circumference of the projection, and the female portion has a dimple which extends substantially radially into the bore. The projection of the male portion also includes a radially reduced or flattened segment which extends from a distal end of the projection to an edge of the groove. The flattened segment is recessed with respect to the circumference of the projection by a distance substantially equal to the distance between a surface of the bore in the female portion and a terminal end of the dimple.

To couple the male portion with the female portion, the projection is positioned with respect to the bore such that the flattened segment is aligned with the dimple. In this manner, the dimple does not substantially interfere with insertion of the projection into the bore. The projection is inserted into the bore until the dimple is laterally aligned with the groove. The groove is radially tapered such that a wall of the groove defines a minimum diameter proximate the flattened segment and defines a maximum diameter at a location on the projection offset circumferentially from the flattened segment. The male portion is rotated with respect to the female portion such that the dimple cams above or along the groove. The spiral-like configuration of the groove draws the dimple, and thus the female portion, proximally along the projection as the dimple cams along the groove. As the dimple moves proximally along the projection, the male portion is drawn towards the female portion. Once the dimple has moved along the groove from the flattened segment to the maximum diameter location of the groove, the projection of the male portion is secured within the bore of the female portion. Thus, the camming action of the dimple along the groove pulls the male portion and the female portion tightly together.

In order to facilitate the camming action of the dimple within the groove, a slot is operatively associated with the groove and extends diametrically along and longitudinally through a section of the projection. The slot is offset about 15 degrees clockwise from a lateral midline of the projection. When the dimple cams within the groove, compressive forces are generated on the projection, which cause the slot to contract. This contraction can generate a spring force which can pull the male and female portions together, and which can facilitate subsequent disconnection of the male and female portions. However, when the dimple reaches the maximum diameter location, the compressive forces generated by the dimple are directed essentially parallel to the slot. By directing the forces essentially parallel to the slot, the compressive forces may have difficulty in contracting the slot. Thus, the relative dispositions of the slot and the dimple can lead inefficient contraction of the slot, thereby making repeated connection and disconnection of the male and female portions more troublesome.

To disconnect the joined male and female portions of the cable connector, the male portion is rotated in an opposite direction with respect to the female portion such that the dimple reverses its direction along the groove until the dimple again reaches the flattened segment. The dimple is essentially free of the groove at this point. An axially directed force applied to the male and/or the female portions may facilitate disconnection thereof.

While this cable connector may be effective in some circumstances, it has a number of characteristics which may make its performance suboptimal in other circumstances. Specifically, this cable connector may be relatively susceptible to problems caused by manufacturing tolerances. For instance, the dimple is formed on the female member by a stamping process. The stamping process is an additional step in the cable connector manufacturing process, and may incorporate certain irregularities which can compromise the effectiveness of the cable connector.

The nature of the stamping process can make it difficult to predetermine and insure uniformity of the length, width, and depth of the dimple on various female portions. Furthermore, inconsistencies in the composition of the material comprising the female portion may also lead to variances in dimple structure. Additional factors, such as material blank tolerance variation, clamp fixture wear, stamp press tonnage variation, and stamping die wear may contribute to the difficulties in producing a dimple of a uniform, predetermined configuration. This may compromise the effectiveness of the cable connector, and may reduce the electrical conductivity of the cable connector.

In addition, the dimple may wear or deform upon repeated connections and disconnections. Because the dimple is an integral part of the female portion, sufficient wear of the dimple may necessitate replacement of the entire female portion of the cable connector. This can become quite expensive, especially upon consideration that the difficulty in insuring uniformity of dimple configuration may further complicate replacement of the female portion, viz. the dimple on the selected femme portion must be compatible with the male portion already installed on the cable. Alternatively, both the male and female portions may be conjointly replaced.

In order to reduce the probability of electrical shock, insulating members are provided. The male and female portions are each mounted in their own insulating member to facilitate connection and disconnection of the male and female portions. To mount the conductive portions in their respective insulators, screws are provided. Thus, to assemble the male and female portions, the additional steps of inserting and tightening the screws to secure the insulating members to the male and female portions are required.

Given these drawbacks, among others, presented by at least some of the prior art cable connectors, it is desirable to have an improved cable connector which is not susceptible to those drawbacks. The present invention is intended to offer such an improvement.

SUMMARY OF THE INVENTION

The present invention provides an improved in-line cable connector which is not subject to some, if not all of the drawbacks presented by the prior art cable connectors. The cable connector of the invention has an improved configuration for facilitating repeated connection and disconnection of male and female elements thereof. Also, the cable connector has a cam element which can have a uniform configuration, and which is replaceable upon sufficient wear to insure effective physical and electrical joinder of ends of electrical cables. Furthermore, the cable connector does not require separate structures for connecting the male and female portions and for connecting those portions to their respective insulators.

A general object of an embodiment of the present invention is to provide an improved electrical cable connector.

A more specific object of an embodiment of the invention is to provide an improved electrical cable connector locatable electrically in-line with an electrical cable.

Another object of an embodiment of the present invention is to provide an improved electrical cable connector having an increased torqueability as compared to some cable connectors of the prior art.

An additional object of an embodiment of the invention is to provide an improved electrical cable connector which allows for increased repeated connection and disconnection thereof as compared to some cable connectors of the prior art.

An electrical cable connector, constructed according to the teachings of the present invention, for connecting ends of an electrical cable comprises a female element coupled to one end of the electrical cable, and a male element coupled to another end of the electrical cable. The male element is releasably connectable with the female element. A locking groove is disposed on one of the female element and the male element. A screw is removably disposed on another one of the female element and the male element. A cam surface is located on the screw and is engagable with the locking groove such that the cam surface cams along the locking groove responsive to rotation of the female element relative to the male element to releasably connect the female element and the male element thereby electrically connecting the ends of the electrical cable. A slot is operatively associated with the locking groove. The slot is contractible responsive to camming of the cam surface along the locking groove to facilitate releasable connection of the female element and the male element. The slot is offset about 45 degrees counterclockwise from a latitudinal midline of the male element.

BRIEF DESCRIPTION OF THE DRAWINGS

The organization and manner of the structure and operation of the invention, together with further advantages thereof, may best be understood by reference to the following description taken in connection with the accompanying drawings, wherein like reference numerals identify like elements in which.

DETAILED DESCRIPTION OF THE ILLUSTRATED EMBODIMENT

Figure 1:
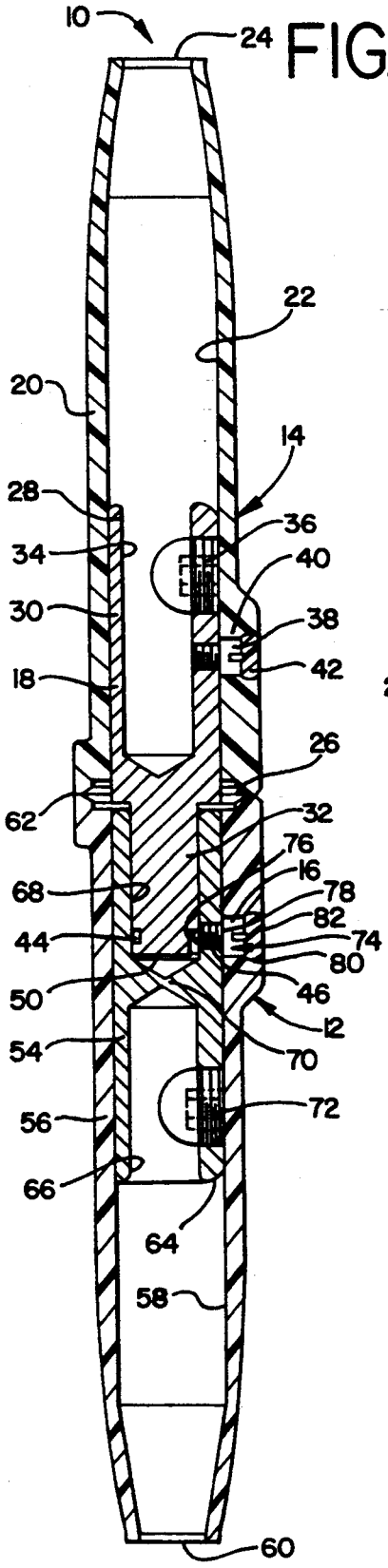
FIG. 1 is a sectioned side elevational view of an in-line quick connect electrical cable connector, constructed according to the teachings of the present invention. comprising releasably joinable male and female elements.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

Referring initially to FIG. 1, a novel, in-line quick connect electrical cable connector 10, constructed according to the teachings of the present invention, is illustrated. The cable connector 10 generally comprises a first or female element 12 and a second or male element 14 removably insertable into the female element 12. The female element 12 and the male element 14 include an attachment mechanism 16 which renders the cable connector 10 substantially free of the drawbacks discussed hereinabove with respect to the prior art cable connectors. While the construction of the cable connector 10 will be discussed herein, for the sake of clarity, with distinct portions of the attachment mechanism 16 being disposed on the female and male elements 12 and 14, respectively, it is to be understood that those distinct portions, to be discussed in greater detail shortly, may be disposed on the other of the male and female portions 12 and 14, without departing from the scope of the present invention.

The male element 14 is shown in FIGS. 1 through 4. Specifically, as shown more clearly in FIG. 2, the male element 14 comprises an electrically conductive member 18 and an electrically insulating member 20. The conductive member 18 and the insulating member 20 are substantially cylindrical in configuration, and the conductive member 18 is preferably made from a metal, such as brass and the like, and the insulating member 20 is preferably made from a polymeric material. The insulating member 20 has a bore 22 which extends axially therethrough of suitable dimensions for allowing the conductive member 18 to be inserted into the insulating member 20. The bore 22 has a proximal opening 24 and a distal opening 26 on opposite ends of the insulating member 20. The proximal opening 24 allows for passage of an electrical cable, not shown, from the exterior of the insulating member 20 into the bore 22, and the distal opening 26 allows a portion of the male element 14 to pass from the bore 22 to the exterior of the insulating member 20. In this manner, an end of the electrical cable can be electrically connected to the male element 14 within the bore 22 in the insulating member 20, as is well known by those skilled in the art.

Figure 2:
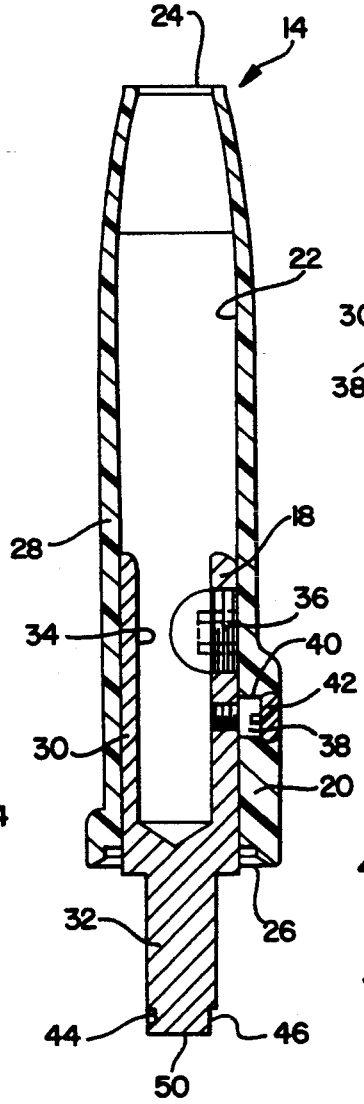
FIG. 2 is a sectioned side elevational view of a male element comprising the cable connector of FIG. 1.
Figure 3:
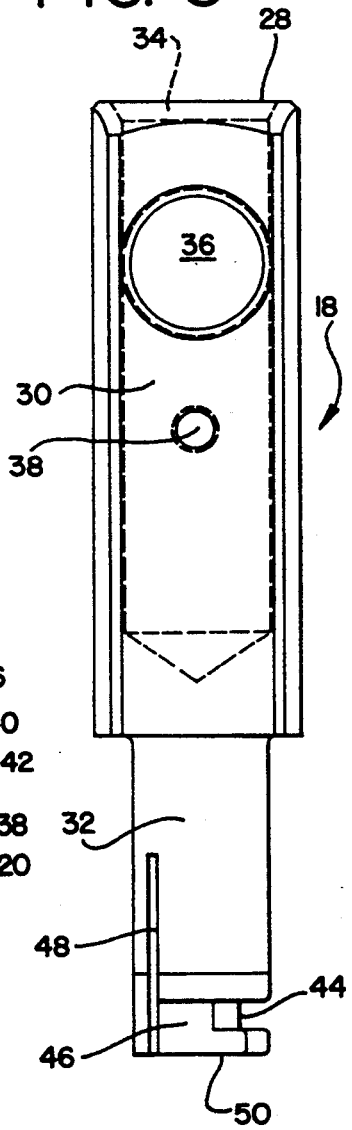
FIG. 3 is an enlarged plan view of a conductive member of the male element of FIG. 2.
Figure 4:
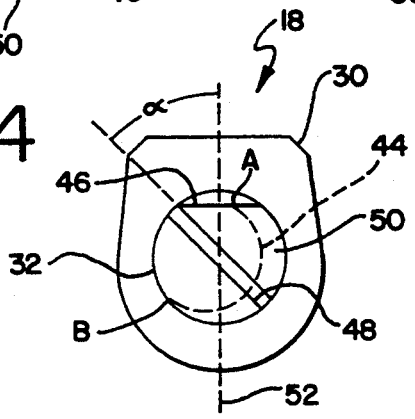
FIG. 4 is an end view of the conductive member of FIG. 3.
Figure 5:
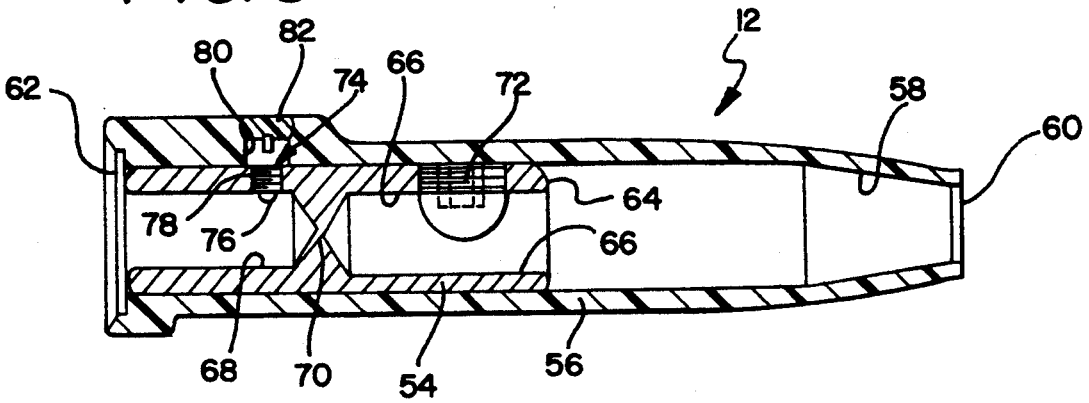
FIG. 5 is a sectioned side elevational view of a female element comprising the cable connector of FIG. 1.
Figure 6:
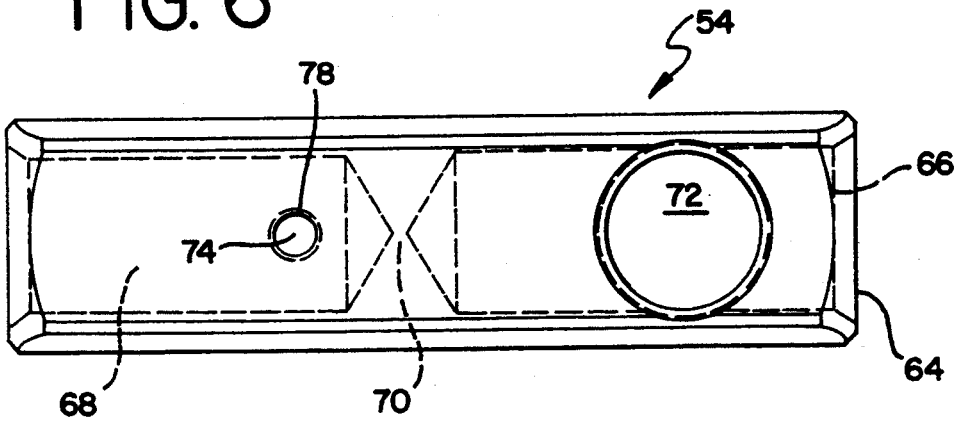
FIG. 6 is an enlarged plan view of a conductive member of the female element of FIG. 5.
Figure 7:
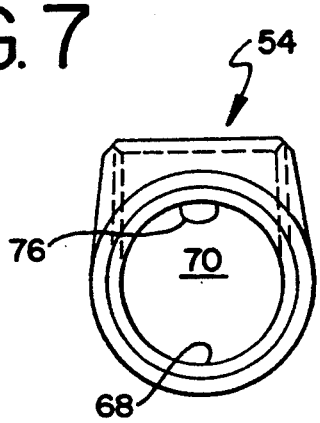
FIG. 7 is an end view of the conductive member of FIG. 6.

The conductive member 18 has an axial length smaller than the axial length of the insulating member 20 so that a proximal end 28 of the conductive member 18 is located within the insulating member 20. The conductive member 18 comprises a hollow portion 30 and a substantially solid projection 32. The hollow portion 30 defines a bore 34 for accepting an end of the electrical cable. In order to secure the electrical cable within the bore 34, a cable set screw 36 threadibly extends through one side of the hollow portion 30. When the cable set screw 36 is sufficiently seated, the end of the set screw 36 clampingly engages an outer diameter surface of the electrical cable. Preferably, the electrical cable is so clamped prior to insertion of the conductive member 18 into the bore 22. While only a single cable set screw 36 is illustrated in FIGS. 1 through 3, it is to be noted that additional cable set screws 36 can be provided without departing from the scope of the invention.

Another screw 38 is threadibly connectible to the conductive member 18, and attaches the conductive member 18 to the insulating member 20. Accordingly, the insulating member 20 has a laterally extending bore 40 for accepting the screw 38, and for permitting access of the screw 38 from the exterior of the insulating member 20. In this manner, when the conductive member 18 is inserted into the bore 22 in the insulating member 20, the screw 38 can be inserted into the bore 40 in the insulating member 20 and threadibly engaged with the conductive member 18.

Because the conductive member 18 is electrically connected to the electrical cable, electrical energy on the cable is transferred to the conductive member 18. From the conductive member 18, the electrical energy can be transferred to the screw 38. In order to minimize the possibility of a shock hazard, the dimensions of the screw 38 and the bore 40 are predetermined such that, when the screw 38 is fully seated, the head of the screw 38 is offset from an exterior surface of the insulating member 20 by a distance sufficient for substantially preventing electrically conductive contact between the screw 38 and a workman's hand or other device. To further prevent such electrically conductive contact, an electrically insulating plug 42 is inserted into the bore 40 such that the plug 42 overlies the head of the screw 38. In addition, the plug 42 is dimensioned such that the insulating member 20 presents a substantially smooth outer surface profile.

The bore 34 in the hollow portion 30 of the conductive member 18 terminates at a location distal of the screw 38 and proximal of the projection 32. The hollow portion 30 has a substantially polygonal outer configuration. At least an adjacent portion of the surface of the bore 22 in the insulating member 20 also has a similar configuration. Because the configuration of the hollow portion 30 and the bore 22 are essentially out of round, rotation of the insulating member 20 about the hollow portion 30 is limited. This may be important considering that the female and male elements 12 and 14, respectively, must be rotated to connect and disconnect the elements 12 and 14. Also, these configurations can minimize the amount of material needed to form the insulating member 20, and can also provide for a snug fit of the cable set screw 36, i.e. the close tolerance between the outer surface of the hollow portion 30 and the inner surface of the bore 22 prevents the cable set screw 36 from backing out of the hollow portion 30 when the conductive member 18 is inserted into the insulating member 20.

The projection 32 extends substantially axially from the hollow portion 30 and generally defines an outer diameter smaller than the outer diameter defined by the hollow portion 30. The projection 32 has a cylindrical configuration and has structures for releasably connecting the female element 12 to the male element 14. As is shown more clearly in FIGS. 3 and 4, the projection 32 includes a substantially spiral-like locking groove 44, a flattened segment 46, and a slot 48. These structures cooperate with corresponding structures on the female element 12 to releasably connect the elements 12 and 14 together. Thus, the locking groove 44, the flattened segment 46, and the slot 48 form a portion of the attachment mechanism 16 disposed on the male element 14.

The locking groove 44 extends along a longitudinal axis and a circumference of the projection 32. The flattened segment 46 is defined by a chord of a latitudinal cross section of the projection 32. A longitudinal end of the flattened segment 46 defines one end of the locking groove 44. At the juncture between the locking groove 44 and the flattened segment 46, indicated by reference character "A" in FIG. 4, the locking groove 44 has a first location which defines a minimum diameter on the projection 32. The locking groove 44 progresses around the circumference of the projection 32 and axially along the projection 32 in a spiral-like fashion. An end, indicated by reference character "B" in FIG. 4, of the locking groove 44 has a second location which defines a maximum diameter on the projection 32. In an exemplary embodiment, the locking groove 44 may be about 0.088 inches wide, and may have a proximal side which defines an 8 degree taper and a distal side which defines a 6 degree taper.

The slot 48 extends substantially along a diameter of the projection 32, and extends from a distal end 50 of the projection 32 a certain distance along the longitudinal axis of the projection 32. The slot 48 is offset on the projection 32 from a latitudinal midline, indicated by dotted line 52, of the projection 32 by an angle $\alpha$. The angle $\alpha$ measures about 45 degrees in a counterclockwise direction, as viewed, from the latitudinal midline of the projection 32. In an exemplary embodiment, the slot 48 has a width of about 0.037 inches, subject to usual manufacturing tolerances. This construction of the slot 48 provides the embodiments of the invention with functional advantages over some of the cable connectors of the prior art. Because the slot 48 is oriented about 60 degrees counterclockwise from the slots of the prior art connectors, the compressive forces for causing contraction of the slot 48, when the male element 14 is fully inserted and rotated in the female element 12, are applied substantially perpendicularly to the slot 48. In addition, the small width of the slot 48 minimizes the compression needed to connect or disconnect the female element 12 from the male element 14.

The construction of the female element 12 will now be discussed. The construction of the female element 12 is illustrated in FIGS. 1, and 5 through 7. The female element 12 comprises an electrically conductive member 54 and an insulating member 56. The outer surface of the conductive member 54 and the inner surface of the insulating member 56 have out-of-round configurations, substantially similar to the configurations of the conductive member 18 and the insulating member 20, discussed earlier, to prevent rotation of the insulating member 56 with respect to the conductive member 54.

The insulating member 56 includes a bore 58 therethrough of sufficient size to accept the conductive member 54. The bore 58 has a proximal end 60 dimensioned for accepting an electrical cable, not shown, and a distal end 62 dimensioned for accepting the conductive member 54. The conductive member 54 has an axial length smaller than the axial length of the insulating member 56 such that a proximal end 64 of the conductive member 54 is offset distally of the proximal end 60 of the insulating member 56. The insulating member 56 is preferably made from a polymeric material.

The conductive member 54 has a substantially cylindrical configuration, and is preferably made of a metal, such as brass. The conductive member 54 has two axially extending bores 66 and 68 therein separated by a septum 70. The bore 66 extends from the proximal end 64 of the conductive member 54 about half of the axial length of the conductive member 54. The bore 66 is sized to accept an end of an electrical cable. To secure the cable within the bore 66, a cable set screw 72 threadibly extends radially into the bore 66. While only one cable set screw 72 is shown in the Figures, it is to be understood that a number of cable set screws 72 can be utilized without departing from the scope of the present invention. The cable set screw 72 clampingly engages the outer surface of the electrical cable inserted into the bore 66.

The bore 68 is dimensioned to accept the projection 32 of the male element 14. In order to releasably connect the female element 12 with the male element another portion of the attachment mechanism 16, namely a cam element or lug screw 74, is provided on the female element 12. The lug screw 74 threadibly extends substantially radially into the bore 68 of the conductive member 54. The lug screw 74 replaces the dimple of the above-discussed prior art cable connectors, and provides the cable connector 10 with functional advantages over the cable connectors for the prior art. It is to be noted that the locking groove 44 and the lug screw 74 may be disposed on either the female element 12 or the male element 14 without departing from the scope of the invention. However, the locking groove 44 and the lug screw 74 cannot be both disposed on the same element 12 or 14.

The lug screw 74 has a configuration and construction which represent a significant improvement over the cable connectors of the prior art. The lug screw 74 includes a substantially domed-shaped entering end 76 which acts as a cam surface which can ride along the locking groove 44 on the projection 32 of the male element 14 responsive to rotation of the male element 14 with respect to the female element 12. The axial length of lug screw 74 is predetermined so that the entering end or cam surface 76 is located at the proper depth within the bore 68 when the lug screw 74 is fully threadibly seated in the conductive member 54. Thus, by tightening the lug screw 74, it is always insured that the cam surface 76 is in proper position to connect and disconnect the female and male elements 12 and 14, respectively.

In addition, the thread profiles on the shank of the lug screw 74 and on a corresponding aperture 78 in the conductive member 54 are chosen such that the rotation of the male element 14 with respect to the female element 12 can cause the lug screw 74 to tighten and fully seat within the aperture 78. In this manner, even if the lug screw 74 is not fully seated initially, rotation of the male element 14 with respect to the female element 12 will cause the lug screw 74 to fully seat within the aperture 78, i.e. camming of the cam surface 76 along the locking groove 44 causes the lug screw 74 to rotate and tighten, thereby insuring proper connection and disconnection of the elements 12 and 14.

With the prior art cable connector constructions, it is a concern that the dimple or cam surface will deform, thereby making the entire female element no longer suitable for use. The cable connector 10 is not subject to this problem. Specifically, because the lug screw 74 is separate from the female element 12, as opposed to the prior art, integrally formed dimple, the lug screw 74 can be manufactured separately from the conductive member 54 of the female element 12, and thus, those parts can be formed from different materials. While the preferred material for the conductive member 54 is brass, a preferred material for the lug screw 74 is 1018 steel. 1018 steel is harder than brass, and can resist deformation to a greater degree than the dimples of the prior art. Other materials can also be used, but it is desirable that the material comprising the lug screw 74 be harder than the material comprising the conductive member 54. Therefore, the cam surface 76 may not wear as quickly as the prior art dimples, thereby extending the operational lifetimes of the female elements 12. Also, because the lug screw 74 and the conductive member 54 are manufactured separately, a large number of identical, uniformly constructed lug screws 74 can be made. This is a significant improvement over the dimple construction of the prior art discussed earlier.

Furthermore, because the lug screw 74 is threadibly inserted into the aperture 78 on the conductive member 54, the lug screw 74 can be removed from the aperture 74 is desired. If the cam surface 76 were to deform or wear such that the associated lug screw 74 was not longer a suitable component of the attachment mechanism 16, then the lug screw 74 can be replaced by a new lug screw 74. Essentially, the lug screw 74 is a replaceable mechanical lock disposed on at least one of the female and male elements 12 and 14. This is a distinct improvement over the integral dimple constructions of the prior art wherein a worn dimple cam surface necessitates replacement of the entire female portion, as discussed hereinabove. Also, because all of the lug screws 74 can be made identical, there is no concern regarding finding a female portion having particular utility with a given male portion. These things can provide a user with greater flexibility, and possibly increased revenue savings. The cam surface 76 provided by the lug screw 74 also improves repeatability of connections and disconnections of the female and male elements 12 and 14, respectively, in the field.

The lug screw 74 also provides additional benefits to the cable connector 10. Some of the prior art cable connectors, such as the one discussed earlier, utilize a dimple to make a connection between the male and female portions, and then use a separate screw for attaching insulating members to the male and female portions. However, with the cable connector 10, the insulating member 56 is attached to the conductive member 54 with the same lug screw 74 which provides the cam surface 76. Specifically, the insulating member 56 has a bore 80 therethrough for allowing access to the lug screw 74 from the exterior of the cable connector 10. When the lug screw 74 is fully seated within the aperture 78, the insulating member 56 is held firmly against the outer surface of the conductive member 54. Thus, by coupling the conductive member 54 and the insulating member 56 by the same lug screw 74 which assists in coupling the female and male elements 12 and 14, respectively, the construction of the cable connector 10 is simpler than the constructions of some prior art cable connectors.

Because the lug screw 74 is attached to the conductive member 54, electrical energy can be transferred from the cable to the conductive member 54, and, from there, to the lug screw 74. In order to reduce the possibility of electrical shock hazard, the dimensions of the lug screw 74 are predetermined such that the head of the lug screw 74 lies within the bore 80 in the insulating member 56 below the outer surface of the insulating member 56 a predetermined distance so that the head of the lug screw 74 is substantially beyond the reach of most adult fingers. In addition, an insulating plug 82 is inserted into the bore 80 above the head of the lug screw 74. The plug 82 can reduce the probability that a workman's hand might electrically contact the lug screw 74. The same is true for the construction of the screw 38 and the insulating plug 42.

In an exemplary embodiment, the lug screw 74 has a the following dimensions. It is to be noted that these dimensions are provided for illustrative purposes only and are not intended to limit the scope of the invention. The head of the lug screw 74 can be about 0.16 inches thick, and the threaded shank of the lug screw 74 can be approximately 0.14 inches long. The cam surface 76 which depends from the threaded shank has an axial length of about 0.06 inches, and a distal portion of the cam surface 76 can define a hemisphere having a radius measuring approximately 0.05 inches. The diameter of the cam surface 76 is about 0.09 inches. All of these dimensions are, of course, subject to the usual manufacturing tolerances.

The operation of the cable connector 10 will now be discussed. It is to be noted that this discussion of the operation of the cable connector 10 is provided to aid the understanding of the reader, and is not intended to limit the scope of the present invention.

Conductive portions of the ends of the electrical cable are revealed by trimming or stripping away a portion of the cable jacket, as is well known by those skilled in the art. To connect the ends of the electrical cable with the cable connector 10, the conductive ends of the cable are inserted through one of the bores 22 and 58 in the insulating members 20 and 56, respectively. The ends of the cable are positioned with respect to the insulating members 20 and 56 such that the tips of the cable extend beyond the distal ends 26 and 62 of the insulating members 20 and 56. The ends of the cable are located within the bores 34 and 66 in the conductive members 18 and 54, and the cable set screws 36 and 72 are tightened to clampingly hold the electrical cable within the conductive members 20 and 54.

The insulating members 20 and 56 are advanced along the cable until the conductive members 18 and 54 are disposed within the insulating members 20 and 56, respectively. To insert the conductive members 18 and 54 into the insulating members 20 and 56, the out of round configurations thereof must be aligned. At this point, the screw 38 is threadibly inserted through the bore 40 in the insulating member 20 and tightened against the conductive member 18 such that the conductive member 18 and the insulating member 20 are fastened together. The insulating plug 42 is inserted into the bore 40 on top of the screw 38. The male element 14 is now complete. The lug screw 74 is inserted into the bore 80 in the insulating member 56 and through the aperture 78 in the conductive member 54. The lug screw 74 is threadibly tightened, thereby fastening the conductive member 54 to the insulating member 56, and locating the cam surface 76 at the appropriate depth within the bore 68. The insulating plug 82 is now inserted into the bore 80 in the insulating member 56. The female element 12 is now complete.

Now, the female element 12 can be connected to the male element 14. The male element 14 is positioned with respect to the female element 12 such that the flattened segment 46 on the projection 32 aligns with the cam surface 76 in the bore 68. This insures that the cam surface 76 will not interfere with the insertion of the projection 32 into the bore 68. The projection 32 is advanced into the bore 68 of the female element 12 until the cam surface 76 engages a proximal side of the locking groove 44. The male element 14 is now rotated with respect to the female element 12.

As the male element 14 rotates with respect to the female element 12, the cam surface 76 moves or cams along the locking groove 44 in the projection 32. The cam surface 76 first encounters the minimum diameter location "A" and, as the male element 14 is further rotated, the cam surface 76 moves along the circumference of the projection 32 via the locking groove 44 towards the location "B". As the cam surface 76 approaches the location "B", the contact between the cam surface 76 and the edges of the locking groove 44 generates a compressive force for clamping the projection 32 within the bore 68. As the male element 14 is rotated substantially one hundred and eighty degrees with respect to the location "A", the compressive force is directed substantially perpendicularly to the slot 48. By directing the compressive force in this manner, more efficient contraction of the slot 48 can occur, thereby facilitating joinder of the female element 12 with the male element 14. Once the cam surface 76 reaches the location "B", the male element 14 is releasably joined to the female element 12, and the electrical and physical connection of the ends of the electrical cable is complete. To disconnect the female and male elements 12 and 14, the above-described steps can be performed in reverse order.

The novel in-line cable connector 10 of the present invention provides a number of distinct advantages and improvements over the cable connectors of the prior art. The construction of the attachment mechanism 16 gives the cable connector 10 increased torqueability as compared to some of the prior art cable connectors. The replaceable lug screw 74, which provides the cam surface 76, allows for increased repeated connections and disconnections without having to replace the conductive members 18 and 54 or the insulating members 20 or 56. Also, the cable connector 10 may be more durable that other cable connectors because elements thereof can be made from different materials. These advantages, among others, can provide a user with greater flexibility, and also possibly greater revenue generation because repair costs need not be as high as they might be with some cable connectors of the prior art.

While embodiments of the present invention are shown and described, it is envisioned that those skilled in the art may devise various modifications of the present invention without departing from the spirit and scope of the appended claims.

We claim:

1. An electrical cable connector for releasably electrically connecting ends of an electrical cable, the cable connector comprising:

a) a female conductive element coupled to one end of the electrical cable;

b) a male conductive element coupled to another end of the electrical cable and releasably connectable with the female conductive element;

c) a locking groove disposed on one of the female conductive element and the male conductive element;

d) a screw disposed on another one of the female conductive element and the male conductive element, said screw having a cam surface engageable with the locking groove after the male conductive element is inserted in the female conductive element, wherein said cam surface cams along the locking groove responsive to rotation of the female conductive element relative to the male conductive element to releasably connect the female conductive element and the male conductive element, thereby electrically connecting the ends of the electrical cable;

e) a slot formed in the conductive element which has the locking groove disposed thereon and being operatively associated with the locking groove; and the slot being contractible responsive to camming of the cam surface along the locking groove to facilitate releasable connection of the female conductive element and the male conductive element.

2. An electrical cable connector as defined in claim 1 wherein the locking groove has a substantially spiral-like configuration along the one of the female conductive element and the male conductive element.

3. An electrical cable connector as defined in claim 1 wherein the locking groove has a first location and a second location; wherein the cam surface cams along the locking groove from the first location to the second location; wherein the cam surface applies a compressive force to the one of the female conductive element and the male conductive element; and wherein the compressive force increases in magnitude as the cam surface moves from the first location to the second location thereby forcing portions of the conductive element which define the slot toward each other to contract the slot.

4. An electrical cable connector as defined in claim 1 wherein the screw is removable from the another one of the female conductive element and the male conductive element.

5. An electrical cable connector as defined in claim 4 wherein the screw includes threads having a first thread profile; wherein the another one of the female conductive element and the male conductive element has threads having a second thread profile and releasably engagable with the threads on the screw; and wherein the first and second thread profiles are predetermined such that the threads on the screw tighten against the threads on the another one of the female conductive element and the male conductive element responsive to rotation of the female conductive element relative to the male conductive element.

6. An electrical cable connector as defined in claim 1 wherein the cam surface has a substantially dome-like configuration.

7. An electrical cable connector as defined in claim 1 wherein the screw is actuable to a predetermined position such that the cam surface is located for camming contact with the locking groove upon rotation of the female conductive element relative to the male conductive element.

8. An electrical cable connector as defined in claim 1 further comprising f) an insulating member surrounding the another one of the female conductive element and the male conductive element; and wherein the screw releasably holds the insulating member to the another one of the female conductive element and the male conductive element.

9. An electrical cable connector as defined in claim 1 wherein the another one of the female conductive element and the male conductive element is formed from a first material; and wherein the screw is formed from a second material harder than the first material.

10. An electrical cable connector as defined in claim 1 wherein the one of the female conductive element and the male conductive element has a latitudinal midline; and wherein the slot is offset on the one of the female conductive element and the male conductive element counterclockwise about 45 degrees from the latitudinal midline.

11. An electrical cable connector for releasably electrically connecting ends of an electrical cable, the cable connector comprising:

a) a first conductive element coupled to one end of the electrical cable;

b) a second conductive element coupled to another end of the electrical cable and releasably connectable with the first conductive element; and c) a locking screw member removably disposed on the second conductive element, said locking screw having a cam surface for camming along the first conductive element responsive to rotation of the first conductive element with respect to the second conductive element to releasably connect the first conductive element with the second conductive element, said screw member includes threads having a first thread profile; wherein the second conductive element has threads having a second thread profile and releasably engagable with the threads on the screw member; and wherein the first and second thread profiles are predetermined such that the threads on the screw member tighten against the threads on the second conductive element responsive to rotation of the first conductive element relative to the second conductive element.

* * * * *

UNITED STATES PATENT AND TRADEMARK OFFICE

CERTIFICATE OF CORRECTION

PATENT NO. : 5,366,392

DATED : November 22, 1994

INVENTOR(S) : Valgene E. Raloff et al.

It is certified that error appears in the above-indentified patent and that said Letters Patent is hereby corrected as shown below:

Column 11, in claim 3, line 10, after "forcing" insert --opposing--.

Column 12, in claim 8, line 2, after "comprising" insert --:--.

Signed and Sealed this

Fourteenth Day of November, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,366,392

DATED : November 22, 1994

INVENTOR(S) : Valgene E. Raloff et al

It is certified that error appears in the above-indentified patent and that said Letters Patent is hereby corrected as shown below:

On the title page, item [73] Assignee insert --Equipment-- after "Welding".

Signed and Sealed this

Twelfth Day of March, 1996

*Attest:*

*Attesting Officer*

BRUCE LEHMAN

*Commissioner of Patents and Trademarks*